US005659106A

United States Patent [19]

Frey et al.

[11] Patent Number: 5,659,106

[45] **Date of Patent: *Aug. 19, 1997**

[54] CATALYTIC DISTILLATION PROCESS FOR MERCAPTAN AND OLEFIN REMOVAL

[75] Inventors: Stanley J. Frey, Palatine; Masami Kojima, Mount Prospect, both of Ill.

[73] Assignee: UOP, Des Plaines, Ill.

[ * ] Notice: The term of this patent shall not extend beyond the expiration date of Pat. No. 5,463,134.

[21] Appl. No.: 493,422

[22] Filed: Jun. 22, 1995

[51] Int. Cl.[6] ..... C10G 25/05; C10G 29/02

[52] U.S. Cl. ..... 585/803; 585/802; 208/208 R; 208/250; 568/59; 568/697

[58] Field of Search ..... 585/802, 803; 568/59, 697; 208/208 R, 250

[56] References Cited

U.S. PATENT DOCUMENTS

| | | | |
|---|---|---|---|
| 4,465,870 | 8/1984 | Herskovits | 568/697 |
| 4,775,462 | 10/1988 | Imai et al. | 208/189 |
| 5,254,748 | 10/1993 | Hensley et al. | 568/697 |
| 5,304,683 | 4/1994 | Sattich | 568/59 |
| 5,321,163 | 6/1994 | Hickey et al. | 568/59 |
| 5,463,134 | 10/1995 | Frey | 568/59 |

OTHER PUBLICATIONS

*Reduce the Cost of Producing TAME* by K.L. Rock presented at the 1994 National Petroleum Refiners Association annual meeting.

*Primary Examiner*—Glenn A. Caldarola
*Assistant Examiner*—Alexander G. Ghyka
*Attorney, Agent, or Firm*—Thomas K. McBride; John F. Spears, Jr.

[57] ABSTRACT

Mercaptans and olefins are removed from paraffin-rich feed streams through the use of dual zone catalytic distillation in the substantial absence of hydrogen. The mercaptans are reacted with the olefins using a first catalyst such as a sulphonated resin to form less volatile thioethers removed as part of a net bottoms stream. The remaining olefins are oligomerized in a higher catalyst zone preferably employing a catalyst, such as a dealuminated Y zeolite, having a higher oligomerization activity at the imposed conditions.

18 Claims, 1 Drawing Sheet

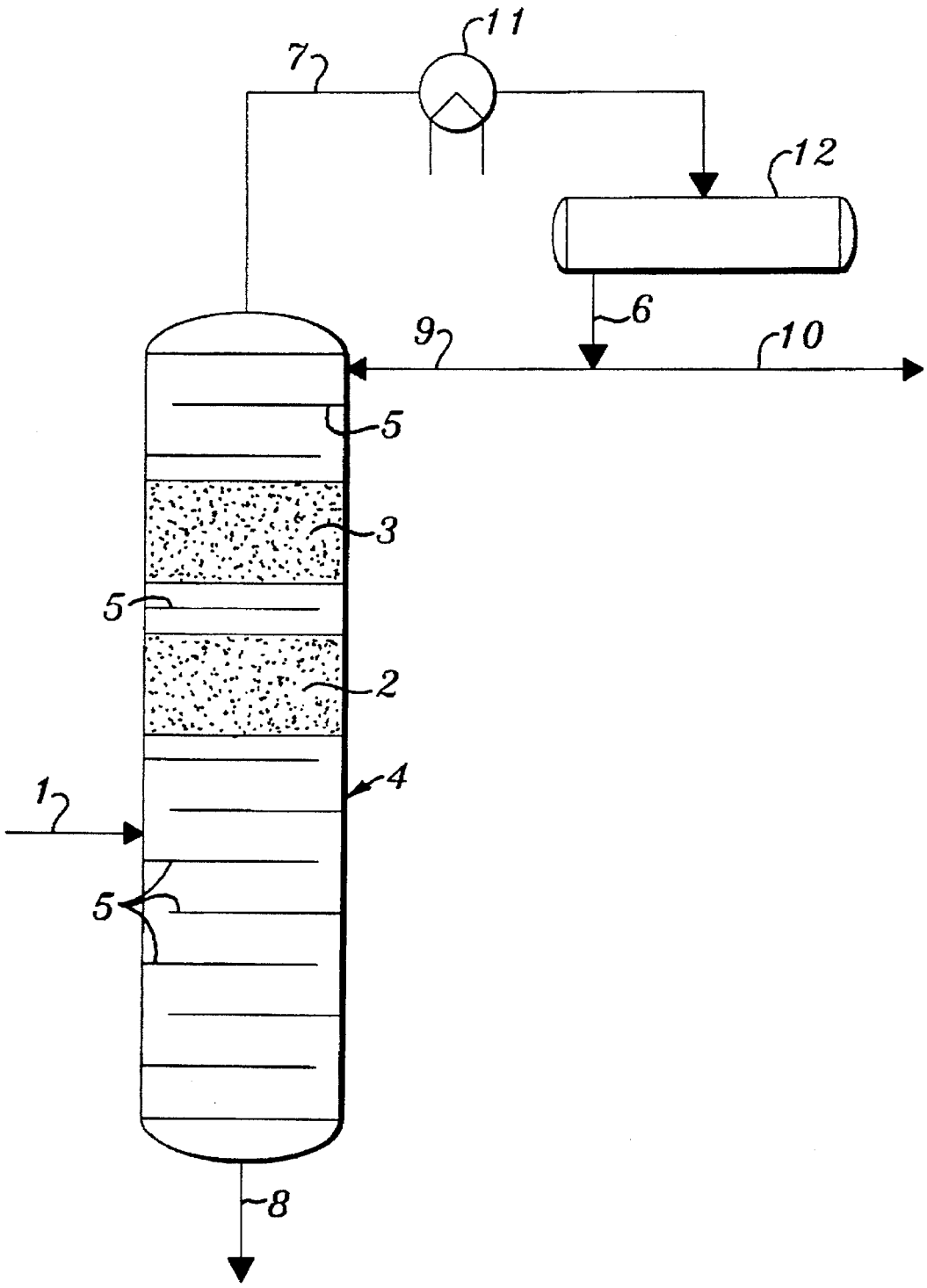
11
7
12
6
9
10
5
3
5
2
4
1
5
8

CATALYTIC DISTILLATION PROCESS FOR MERCAPTAN AND OLEFIN REMOVAL

BACKGROUND OF THE INVENTION

Large quantities of paraffins are consumed in commercial processes which produce motor fuel by alkylation reactions or produce ethers including methyl tertiary butyl ether (MTBE) by etherification reactions. The production of these compounds is often a multistep process which requires recycling various intermediate paraffin-rich process streams. For instance a large etherification complex which consumes isobutylene will normally contain a catalytic paraffin dehydrogenation unit and a catalytic isomerization unit in addition to the etherification unit. These additional units convert normal butanes into the isobutylene consumed in the etherification unit. The recycled process streams often contain nonparaffinic compounds detrimental to the catalysts and adsorbents employed in these processing units, and it is necessary to remove the nonparaffinic compounds by some means.

The fresh feed stream to a hydrocarbon conversion unit or to an overall processing complex may also contain contaminant compounds which are injurious to the catalyst used in the process. In the case of a paraffinic fresh feed stream produced in a petroleum refinery these are likely to be indigenous sulfur compounds such as mercaptans, oxygenates (e.g., methanol), water and olefins. Natural gas-derived butane feed streams may also need treatment to remove mercaptans and other contaminants.

FIELD OF THE INVENTION

The invention relates to a process for removing undesired contaminants from paraffinic feed streams destined for hydrocarbon conversion process units. More specifically the invention relates to a process for removing mercaptans, oxygenates and olefins from a paraffin rich stream through the use of catalytic distillation. The invention is directly concerned with a process to deliver pure $C_4$ paraffins to a stand-alone butane isomerization unit or to a butane isomerization zone used in an etherification complex and which eliminates butenes, alcohol, water and mercaptans from the feed stream to the isomerization zone.

RELATED INFORMATION AND PUBLICATIONS

An overall process flow for an etherification complex receiving an external feed stream and having a recycle stream from the etherification unit is shown in U.S. Pat. No. 4,465,870 issued to L. E. Herskovits. This reference employs adsorption to remove the small amounts of oxygenates such as the product ether and feed alcohol present in the $C_4$ recycle or "raffinate" stream recovered from the effluent of the etherification zone to avoid deleterious impacts on the catalysts in the isomerization and/or dehydrogenation reaction zones of the overall complex. This reference also shows the admixture of the fresh butane feed stream, which is the potential source of mercaptans and olefins, into the recycled raffinate.

U.S. Pat. No. 4,775,462 issued to T. Imai and J. C. Bricker describes a non-oxidative method for the sweetening of a sour hydrocarbon fraction. The hydrocarbon fraction is contacted with an acid-type catalyst in the presence of an unsaturated hydrocarbon to convert the mercaptans to thioethers. The applicable catalysts are described as including polymeric sulfonic acid resins, and butenes are indicated as suitable unsaturated hydrocarbons.

A paper entitled *Reduce the Cost of Producing TAME* by K. L. Rock presented at the 1994 National Petroleum Refiners Association annual meeting describes two treatment methods for an olefinic hydrocarbon feed stream which is to be charged to an etherification zone. One such method is to contact the feed stream with an aqueous caustic solution and to the convert the extracted mercaptans to disulfides via an oxidative reaction. The second method, described on page 4, involves the reaction of the diolefins present in the feed stream with the mercaptans which are also present in the feed stream to form a sulfide. This is performed in the presence of hydrogen used for olefin saturation.

U.S. Pat. No. 5,321,163 issued to T. P. Hickey et al. describes a multipurpose catalytic distillation column having two catalytic distillation zones disposed above a stripping section. One of the reactions which may be simultaneously performed in the column is the reaction of mercaptans with diolefins to form disulfides removed from the bottom of the column. The remainder of the diolefins are reacted with hydrogen in the presence of a hydrogenation catalyst.

BRIEF SUMMARY OF THE INVENTION

The invention is a process for treating a paraffin-rich hydrocarbon stream to reduce the levels of mercaptans and olefinic hydrocarbons in the hydrocarbon stream. The subject invention has the advantages of greatly reducing the size and complexity of the equipment needed to remove these compounds from the paraffin stream and therefore greatly reduces the capital cost of this operation. The invention also eliminates the need to use chemical treating agents such as "caustic" (aqueous sodium hydroxide solution) and to dispose of used caustic, which are inherent costs and problems in the prior art oxidative mercaptan removal processes.

One broad embodiment of the invention may be characterized as a process for the removal of mercaptans and $C_4$ olefins from a $C_4$ paraffin-rich feed stream which comprises the steps of passing the feed stream, comprising at least a first paraffinic hydrocarbon, at least a first olefinic hydrocarbon and at least one coboiling mercaptan, with mercaptan and olefinic hydrocarbons being present in the feed stream at a concentration of less than 10 volume % each, into a catalytic distillation column operated at conditions effective to separate the compounds present in the column into a net overhead stream, which comprises substantially all of the first paraffinic hydrocarbon which enters the column in the feed stream, and a net bottoms stream which comprises sulfur compounds and dimers of the first olefinic hydrocarbon with the feed stream entering the catalytic distillation column at a first elevation; contacting the first olefinic hydrocarbon and the mercaptan, present in the feed stream, in the substantial absence of hydrogen, with thioetherification catalyst located at a second elevation in the catalytic distillation column and maintained at conditions which effect the production of thioethers by the reaction of mercaptan present in the feed stream with a portion of the first olefinic hydrocarbon; contacting the remaining portion of the first olefinic hydrocarbon, in the substantial absence of hydrogen and thioethers, with oligomerization catalyst located at a third elevation in the catalytic distillation column, which third elevation is higher than said second elevation, and maintained at conditions which effect the production of oligomers by the dimerization of the first olefinic hydrocarbon, which has risen through said thioetherification catalyst and, removing said net bottoms stream and said net overhead stream, comprising paraffinic hydrocarbons, from the column. The absence of thioethers in the oligomerization catalyst bed prevents the thioethers from decomposing, which would allow the released olefin to be consumed in the relatively irreversible dimerization reaction and thus not being available for mercaptan removal.

BRIEF SUMMARY OF THE DRAWING

The drawing is a very simplified diagram of a catalytic distillation column 4 enclosing a lower bed 2 of thioetherification catalyst for the reaction of mercaptans and olefins in zone and a separate bed 3 of oligomerization catalyst in a higher zone.

DETAILED DESCRIPTION AND PREFERRED EMBODIMENTS

As previously stated, it is often necessary to remove various low level contaminants from paraffinic feed and recycle streams charged to hydrocarbon conversion units. This may be needed in the case of an integrated process for the production of ethers. It may also be necessary to remove mercaptans and olefinic hydrocarbons from the feed stream of a stand-alone or once-through hydrocarbon conversion unit. For instance paraffinic $C_4$ feedstreams to an isomerization unit derived from natural gas will often contain some mercaptans. A second example is a paraffinic feed stream to an isomerization, dehydrogenation or etherification unit which is derived from a fluidized catalytic cracking (FCC) unit. This feed will normally contain some mercaptans and mono and di-olefins. Several different mercaptans including $C_1$, $C_2$, and $C_3$ mercaptans can be present simultaneously. Passage of these untreated feed streams into the once-through isomerization or etherification units or into an integrated etherification complex will introduce the undesired mercaptans and olefins to the reaction zones.

In the specific case of an integrated etherification complex the recycle $C_4$ stream, often referred to as the $C_4$ raffinate, is normally recovered from the effluent of the etherification reactor. This effluent is subjected to a fractionation operation to remove the higher boiling ethers and a water wash intended to recover the feed alcohol. The remaining $C_4$ raffinate stream will normally contain some residual alcohol which is not removed by the water wash and will also contain some water picked up in the water washing step. It will also contain a small amount of the product ether such as MTBE and by-product oxygenates such as dimethyl ether. These materials should normally be removed before the raffinate is passed into a catalytic isomerization zone in order to protect the isomerization catalyst.

It is an objective of this invention to provide a method for treating the $C_4$ or $C_5$ paraffin containing feed streams to a hydrocarbon conversion zone to remove mercaptans and olefinic hydrocarbons. It is a further objective of the subject process to provide an improved method for treating the combined paraffin recycle and feed streams of an integrated etherification complex to remove oxygenates and/or water. Yet another objective of the invention is the elimination or reduction of the mercaptan and olefin content of a light paraffin stream in a catalytic distillation column without the presence of hydrogen in the column or in the overhead vapor of the column.

The subject invention achieves these objectives by the use of a catalytic distillation column containing two beds of catalyst located at different levels to first remove the mercaptans and to then remove olefins by oligomerization to high-boiling dimers. Each catalyst bed promotes the reaction of contaminants and their conversion into compounds which can be blended into motor fuel. More specifically the subject invention employs catalytic distillation to effect the reaction of the mercaptans in the paraffinic stream with olefinic hydrocarbons to produce thioethers. The invention also employs catalytic distillation to remove olefins by causing them to react to form dimers or oligomers. The thioethers and oligomers are concentrated into the net bottoms stream of the catalytic distillation column and the purified light paraffins are recovered as the net overhead stream.

The subject process eliminates olefins from the feed stream without the use of hydrogen. This is extremely advantageous when it is desired to perform mercaptan and olefin reduction via catalytic distillation using an existing splitter fractionation column. Such columns, designed for splitting a feed into two hydrocarbon fractions, do not normally have an overhead vapor system designed to handle any significant amount of non-condensible gases such as hydrogen. It would be quite costly to revamp the overhead system to accommodate hydrogen. In addition hydrogen would become dissolved in the overhead liquid of the column, which may adversely affect the operation of downstream facilities and conversion zones. It is therefore greatly beneficial to be able to remove, or at least greatly reduce, the olefin level of the column feed without the use of hydrogen.

Two preferably different catalysts located in two different beds or zones are used in the subject process. The lower bed is located above, at, or partially below the feed point to the column and is used primarily to perform the thioetherification reaction. Preferably it is located above the feed point. This lower bed preferably uses a catalyst which is capable of promoting the reversible thioetherification reaction but is not capable of significantly promoting oligomerization at the chosen operating temperature. In contrast the upper catalyst bed uses a catalyst having a significantly higher activity for oligomerization at the chosen operating temperature to promote the near irreversible dimerization reaction. This separation of the reactions has been found to be needed to prevent the irreversible dimerization reaction from consuming olefins and thereby shifting thioether equilibrium, which would cause the reversion of the thioether and the release of the mercaptan. The removal of olefinic hydrocarbons, which would be otherwise consumed in the thioetherification reaction, limits the removal of the mercaptans. However the separation of the two reaction zones results in the mercaptans being converted to the thioethers, which are removed from the system, before the remaining olefinic hydrocarbons are converted into dimers. This spacial separation of the reactions promotes maximum mercaptan removal.

The overall process flow of the subject invention can be best described by reference to the Drawing. While this Drawing and much of the description herein is set in terms of the treatment of a butane rich stream, the subject process can be adapted to the treatment of other feedstreams including those rich in pentanes or propane. The Drawing is a simplified flow diagram of a preferred embodiment comprising a catalytic distillation column 4 which receives a butane-rich feed stream of line 1 containing some mercaptans and butenes and a small (less than 3 mole %) amount of $C_3$ and $C_5$ hydrocarbons. The feed stream contains etherification zone "$C_4$ raffinate" and therefore comprises some, but less than 2,000 ppm, product ether, feed alcohol and water from an etherification zone not shown. Alternative feeds could contain considerably more paraffins having other than four carbon atoms per molecule and the column would function as a splitter column. This feed admixture is heated by a means not shown and then passed onto a fractionation tray 5 located at an intermediate point in the column. It is immediately subjected to a fractional distillation effect which drives the more volatile components upward. The column is operated at conditions which cause essentially all of the entering admixture to be eventually vaporized and to ascend through the column, while the $C_5$ hydrocarbons begin moving downward.

The vapors formed in the lower portion of the column travel upward and enter into the thioetherification zone 2 which contains a bed of an acidic thioetherification catalyst. The preferred elevation of this bed relative to the feed point varies depending on the volatility of the mercaptans. High molecular weight mercaptans allow the first bed to be lower in the column. An equilibrium amount of the compounds in the vapor enter into the liquid phase in this zone and come into contact with the catalyst. This causes a number of different reactions to occur with the result being the conversion of substantially all of the undesired Monolefinic contaminants into less volatile compounds which tend to migrate downward through the column with the liquid phase. For instance the mercaptans react with tertiary olefins and/or diolefins to form thioethers. Alcohol fed to the column can react with tertiary or secondary mono-olefins to form ethers. Any remaining alcohol will react with the isobutylene to form ethers. Water will react with olefins to form higher, less volatile alcohols. These products then descend through the column and are concentrated into the net bottoms stream of line 8.

The paraffinic $C_4$ hydrocarbons are essentially inert in this environment at the conditions employed in the column and gradually pass upward through the column in a rising vapor phase carrying the remaining olefinic hydrocarbons. The vapors pass upward through more fractionation trays 5 preferably providing fractionation equal to at least two theoretical contacting stages. These separation stages are to ensure the thioethers formed in the lower zone do not enter the upper catalyst zone. The remaining olefinic hydrocarbons eventually enter into the liquid phase present in the oligomerization zone 3. This zone contains a bed of a catalyst which more actively promotes the oligomerization of the olefinic hydrocarbons into dimers or trimers, which are less volatile and therefore also descend to the bottom of the column. The remaining purified paraffinic hydrocarbons continue to move upward through the column and are eventually withdraw as the overhead vapor of line 7. The overhead vapor is condensed in a cooler 11 to form a liquid which is collected in the receiver 12. The overhead liquid is removed in line 6 and divided into the reflux liquid stream of line 9 and a second portion withdrawn through line 10 as the net overhead product. As an alternative a condenser may be located in the top section of the column. At the bottom of the column a liquid-phase bottoms stream comprising the dimers, thioethers and $C_5$ paraffins but substantially free of $C_4$ hydrocarbons is withdrawn via line 8. The compounds present in this stream are suitable for blending into a motor fuel stream. Meat is added to the bottom of the column by a reboiling means not shown.

As used herein the term "substantially free" is intended to indicate the lower of 1.0 mole percent or one-tenth of the concentration of the indicated compound fed in the feed stream to the relevant column or conversion zone. The term "substantially all" is intended to indicate at least 90 mole percent of the indicated compound or class of compounds. The term "rich" is intended to indicate a concentration greater than 50 mole percent and preferably greater than 75 mole percent. Unless otherwise specified, all references herein to concentrations are to mole percent of the indicated compound(s).

The subject process can be adopted to a variety of feed streams. The basic criterion is that the feed stream comprises a paraffinic hydrocarbon which is not affected by the catalytic reactions performed to remove the contaminants. The preferred feed stream is rich in a single paraffinic hydrocarbon but the feed stream may comprise an admixture of two or more paraffins. Suitable paraffins include ethane, propane, butane, pentane, hexane, heptane, octane and nonane. The process may also be applied to a feed comprising a mixture of hydrocarbons such as an FCC gasoline fraction or other light naphtha. The feed stream must also contain undesired olefinic hydrocarbons and mercaptans boiling in the same temperature range as the paraffins.

The subject process can be performed in a fractionation column of relatively normal design through the addition of the catalyst-retaining zones. The process can also be performed in a column specifically built for the purpose. In either instance the apparatus for the noncatalytic portions of the column may be built in accordance with the principles and methods for conventional fractionation columns. These sections of the column may contain either trays or packing (structured or dumped) or both types of vapor-liquid contacting devices.

The general conditions which may be employed within the column are set by the temperature requirements of the catalyst and the thermodynamic characteristics of the reactants. A minimum temperature for operation will normally be set by the activity of the catalyst. The operating pressure of the column will then be adjusted to provide vapor-liquid conditions which allow fractional distillation at this temperature. The open communication within the column dictates that both catalyst zones are operated at approximately the same temperature and pressure, with the largest potential difference being a lower temperature in the oligomerization zone due to its higher location in the column.

A general range of operating conditions suitable for the catalytic distillation zone of the subject process include an overhead temperature of about 40 to about 300 degrees C., preferably about 50 to about 150 degrees C., and a pressure as required to maintain at least a major portion (greater than about 40 mole %) of the feed paraffinic hydrocarbons present as a liquid. Pressures in the general range of from about 200 to about 4000 kpa (30 to 600 psig) are believed suitable. The liquid hourly space velocity (L.H.S.V.), defined as the net overhead liquid rate divided by the volume of catalyst in the column is preferably between about 0.1 and 10 $hr^{-1}$.

The catalyst(s) used in the subject process can be held in the catalytic distillation zone in a number of mechanically different apparatuses. The catalyst could simply rest on a perforated tray with a screen covering the top of the catalyst bed. The catalyst may also be located in the downcomers of a tray or in a number of specialized retention volumes specifically designed for catalytic distillation as shown in U.S. Pat. Nos. 4,302,356; 4,439,350 and 4,443,559. It is also known that a resin catalyst can be present as a coating on various column internals including vapor-liquid contacting devices. It is preferred that the catalyst is retained in a structured packing which contributes to vapor-liquid contacting and which provides sufficient open volume to allow countercurrent vapor and liquid flow. The preferred apparatus for retaining the catalyst in the catalytic distillation zone is described in detail in U.S. Pat. No. 5,073,236 issued to A. P. Gelbein which is incorporated herein for its description as to the structure and use of the preferred catalyst packing systems. This apparatus is preferred because of its ability to disperse the catalyst throughout the catalytic distillation zone while also being highly effective in promoting vapor-liquid contacting and fractional distillation of the products from the reactants within the catalyst-containing zone.

A wide variety of catalysts including zeolites can be employed in both reaction zones of the subject invention. The preferred thioetherification catalyst comprises an acidic resin. A macroporous acid form sulfonic ion exchange resin as described in U.S. Pat. No. 2,922,822 having a degree of cross-linking of from about 5 to 60% is an example. Suitable resin catalysts are available commercially from a number of vendors. Sulfonated resin catalysts such as those sold by Rohm & Haas under the Amberlyst 15 and Amberlyst 36 trademarks are especially preferred. The resin may contain one or more metals. The catalysts can include a refractory oxide such as alumina, silica-alumina, or titania as a support for the catalytic material. The thioetherification catalyst may comprise a synthetic material such as MCM-41 or a clay such as saponite or beidellite clay. MCM-41 and its preparation are described in WP 91/11390, WP 93/00165 and U.S. Pat. Nos. 5,344,553 and 5,264,116. MCM-41 is an inorganic, porous, non-layered crystalline material exhibiting, after calcination, an X-ray diffraction pattern with at least one peak at a d-spacing greater than about 18 Å and a benzene adsorption capacity of greater than 0.25 g/g at 50 torr and 25° C.

The oligomerization catalyst employed in the process is preferably a more active catalyst for oligomerization at the chosen conditions. Again this catalyst can be chosen from a wide variety of known materials. The oligomerization catalyst does not have to be an acidic catalyst or a more "active" catalyst for any reaction other than oligomerization, and this relative activity can be dependent on the imposed operating conditions. The catalyst may comprise a nonzeolitic molecular sieve (NZMS) such as described in U.S. Pat. Nos. 5,114,563 (SAPO) or 4,793,984 or a zeolite such as zeolite Y, MCM-41, synthetic mica-montmorillonite or supported nickel oxide can be employed. The support may be alumina or silica-alumina.

The two catalysts may be differentiated by recognition that the thioetherification catalyst must be capable of complete conversion of the mercaptans in the lower catalyst bed without significant oligomerization of the olefins. The conditions imposed on the catalyst such as temperature and L.H.S.V. can have a great impact on their ability to function as either catalyst. The oligomerization reactions, principally dimerization, are for purposes of this process irreversible while the thioetherification is reversible. A nonselective catalyst, or reaction conditions, which promote both forward reactions can therefore result in all of the olefins being consumed exclusively in the oligomerization reaction leaving no olefins to remove the mercaptans in the thioetherification reaction.

EXAMPLES

The following tests illustrate that Amberlyst 36 and MCM-41 satisfy the requirement that their thioetherification activity at 80°–90° C. is much higher than their oligomerization activity.

A n-butane feed containing 225 wt. ppm methyl mercaptan, 290 wt ppm ethyl mercaptan, 3500 wt ppm i-butene and 2000 wt ppm n-butenes was passed through a fixed bed (once-through) pilot plant reactor containing a bed of Amberlyst 36 acidic resin catalyst. The reactor was maintained at 85° C., and 300 psig (2069 kPa). The feed liquid hourly space velocity (L.H.S.V.) was 5.0. Effluent analysis indicated mercaptan conversion was over 99%. Isobutene conversion was approximately 45%.

In a second test the experiment was repeated using a catalyst comprising MCM-41 having a silica to alumina ratio of 20 in a single fixed bed. The butane feed stream contained 50 wt ppm methyl-mercaptan, 120 wt ppm ethylmercaptan, 5,400 wt ppm i-butene, 4,000 wt ppm n-butenes and trace oxygenates. The reactor was operated at 90° C., a pressure of 300 psig (2069 kPa) and an L.H.S.V. of 5.0. Mercaptan conversion was 98.5%, with the presence of oxygenates believed to have suppressed conversion. Butene conversion was not complete.

In a third experiment a butane feed stream comprising approximately 10 wt. % butenes was passed into a pilot plant containing a bed of dealuminated Y zeolite having a silica to alumina ratio of 11 in a catalytic distillation type configuration. This system was found capable of oligomerizing the butenes at 60°–100° C. for one week with no apparent deactivation.

The concept of the invention was verified through a pilot plant test conducted using a once-through reactor. The feed to the reactor was a liquid phase hydrogen-free $C_4$ stream which was rich in $C_4$ paraffins and contained 1000 wt-ppm isobutene, 2700 wt-ppm normal butene, 225 wt-ppm methyl mercaptans as sulfur and 290 wt-ppm ethyl mercaptans as sulfur. The reactor contained a single bed of catalyst and was operated at various temperatures, from 80 to 110 degrees C. and a constant pressure of 2068 kPa (300 psig), which resulted in liquid-phase conditions. The feed was passed through the reactor at an LHSV of 5.0 $hr^{-1}$. Sixty-three percent of the mercaptans was converted to heavier sulfides. Isobutene conversion was 83%.

At higher temperatures where significant oligomerization takes place, the sulfur conversion to thioethers fell. As the temperature was reduced from 110° C. to 90° C., the mercaptan conversion increased. At 90° C. mercaptan conversion was 92% and isobutene conversion was 61%. When the temperature was further reduced from 90° C. to 80° C., the mercaptan conversion response varied slightly depending upon feed compositions. Higher isobutene compositions tended to give lower optimal temperatures for mercaptan conversions than did feeds lower in isobutene within the 80°–90° C. range. This is due to the reduction in oligomerization of isobutene caused by the 110° C. to 90° C. temperature reduction providing more excess isobutene to shift the mercaptan plus isobutene to thioether reaction equilibrium toward the thioether. Near and below 80° C. the reaction kinetics begin to negatively effect the mercaptan conversion and the isobutene conversions begin to fall. Representative mercaptan conversion was 88% and isobutene conversion was 56%.

This demonstrates that a high degree of oligomerization of isobutene in wt.-ppm olefin streams will inhibit high conversions of mercaptans to thioethers because the thioethers quickly decompose to the mercaptan and isobutene. As the isobutene disappears by oligomerization, the thioethers decompose to relieve the equilibrium.

This nonoptimized test also showed this procedure was effective in significantly decreasing the concentration of olefinic hydrocarbons and mercaptans in the feed stream by their conversion to thioethers and dimers and/or oligomers. Increased conversion can be achieved by conventional means such as increased residence time in a catalytic distillation column.

The process of the current invention first removes the mercaptans in a lower bed by using a catalyst selective for thioetherification. The thioethers are a higher boiling, less volatile component and descend down the column while the sulfur-free $C_4$'s hydrocarbons continue up the column to an oligomerization zone, preferably containing a different catalyst which is more active for oligomerization of the olefins. The oligomerization reaction produces compounds having a higher boiling point from the olefins remaining after the thietherification reaction. In this way the thioetherification and oligomerization reactions are decoupled and do not compete with each other. This results in good conversion of both olefins and mercaptans.

In another test Amberlyst 15 resin was used as the catalyst. The LHSU was 5 $hr^{-1}$, the pressure was 300 psig and the temperature was 65° C. The feed contained 225 wt. ppm methyl mercaptan, 290 wt. ppm ethyl mercaptan, 2200 wt. ppm i-butene and 510 ppm in-butenes. Mercaptan conversion was 99.9% and i-butene conversion was 40%. Amberlyst 15 therefore appears more active in this application.

A preferred embodiment of the subject invention can accordingly be characterized as a process for simultaneously decreasing the concentration of mercaptans and $C_4$ olefins in a $C_4$ paraffin-rich process unit feed stream which comprises the steps of passing the feed stream, which comprises at least 50 percent $C_4$ feed paraffins, about 0.01 to 5.0 percent $C_4$ feed olefinic hydrocarbons and at least one coboiling mercaptan, with the mole ratio of tertiary olefins to mercaptans in the feed stream being greater than about 1:1 (preferably from 2:1 to 8:1), into a catalytic distillation column operated at conditions which effect the separation of the compounds present in the column into a net overhead stream, which comprises substantially all of the paraffins which enter the column in the feed stream, and a net bottoms stream which comprises sulfur compounds and dimers formed from compounds present in the feed stream; contacting the $C_4$ olefinic hydrocarbons and mercapatan, in the substantial absence of hydrogen, with a bed of acidic thioetherification catalyst located at a first level in the catalytic distillation column located above the point at which the feed stream enters the column and maintained at conditions which effect the production of thioethers by the reaction of mercaptans present in the feed stream with tertiary olefinic hydrocarbons present in the feed stream; passing the remaining $C_4$ olefinic hydrocarbons upward in the catalytic distillation column and concurrently contacting the remaining $C_4$ olefinic hydrocarbons, in the substantial absence of thioethers or hydrogen, with a bed of oligomerization catalyst located at a second, higher level in the catalytic distillation column and maintained at conditions which effect the production of oligomers by the reaction of olefinic hydrocarbons which have risen through said first catalyst bed; and, removing said net bottoms stream and the net overhead stream, which is substantially free of mercaptans and olefinic hydrocarbons from the column.

While the previous description of the subject process has been in terms of the catalyst(s) being in two separate beds, there is believed to be no inherent requirement for this. For instance, the catalytic distillation column could comprise a single unitary zone formed from the preferred catalyst retaining contacting system referred to above. Such a unitary catalyst bed must, however, be designed and operated to meet the basic requirement that the thioetherification reaction is completed in the lower portion of the bed or zone while only a minimum, noninterferring amount of olefin oligomerization occurs in the lower portion of the bed. This can be accomplished through the use of a single catalyst which very preferentially promotes thioetherification to the extent that the thioethers are formed and removed to the bottom of the column without interference by oligomerization. Alternatively the unitary catalyst retaining zone can be loaded with two separate (different) catalysts as described above for use in separate beds, with the catalysts being segregated at different elevations within the unitary catalyst-containing zone instead of being in separated beds.

Differences in catalyst activity for a desired reaction at the imposed conditions can be compensated for to a limited degree by a design which adjusts the average contact time between the catalyst and the reactants. For instance, a larger quantity of the thioetherification catalyst or a more vertically spaced apart distribution of the catalyst in the catalytic distillation column can increase the effective contact time between the mercaptans and the catalyst.

This alternative embodiment of the subject process may be characterized as a process for the removal of mercaptans and $C_4$ olefins from a $C_4$ paraffin-rich feed stream which comprises the steps of passing the feed stream, comprising $C_4$ feed paraffinic hydrocarbons, $C_4$ feed olefinic hydrocarbons and at least one coboiling mercaptan, with the mercaptan and the olefinic hydrocarbons being present in the feed stream at a concentration of less than 10 volume % each, into a catalytic distillation column operated at conditions effective to separate the compounds present in the column into a net overhead stream, which comprises substantially all of the lightest feed paraffinic hydrocarbon which enters the column in the feed stream, and a net bottoms stream which comprises sulfur compounds and dimers of the $C_4$ olefinic hydrocarbons present in the feed stream, with the feed stream entering the catalytic distillation column at a first elevation; contacting the $C_4$ olefinic hydrocarbons and mercapatan(s) present in the feed stream, in the substantial absence of hydrogen, with thioetherification catalyst located at a second elevation in the catalytic distillation column and maintained at conditions which effect the production of thioethers by the reaction of mercaptans present in the feed stream with olefinic hydrocarbons present in the feed stream; contacting the remaining $C_4$ olefinic hydrocarbons, in the substantial absence of hydrogen and thioethers, with oligomerization catalyst located at a third elevation in the catalytic distillation column, which third elevation is higher than said second elevation, and maintained at conditions which effect the production of oligomers by the dimerization of olefinic hydrocarbons which have risen through said thioetherification catalyst; and removing said net bottoms stream and the net overhead stream, comprising $C_4$ paraffinic hydrocarbons, from the column.

What is claimed:

1. A process for the removal of mercaptans and olefins from a paraffin-rich feed stream which comprises the steps:

(a) passing the feed stream, comprising at least a first paraffinic hydrocarbon, at least a first olefinic hydrocarbon and at least one coboiling mercaptan, with mercaptan and olefinic hydrocarbons being present in the feed stream at a concentration of less than 10 volume % each, into a catalytic distillation column operated at conditions effective to separate the compounds present in the column into a net overhead stream, which comprises substantially all of the first paraffinic hydrocarbon which enters the column in the feed stream, and a net bottoms stream which comprises sulfur compounds and dimers of the first olefinic hydrocarbon, with the feed stream entering the catalytic distillation column at a first elevation;

(b) contacting the first olefinic hydrocarbon and the mercaptan, present in the feed stream, in the substantial absence of hydrogen, with thioetherification catalyst located at a second elevation in the catalytic distillation column and maintained at conditions which effect the production of thioethers by the reaction of mercaptan present in the feed stream with a portion of the first olefinic hydrocarbon;

(c) contacting the remaining portion of the first olefinic hydrocarbon, in the substantial absence of hydrogen and thioethers, with oligomerization catalyst located at a third elevation in the catalytic distillation column, which third elevation is higher than said second elevation, and maintained at conditions which effect the production of oligomers by the dimerization of the first olefinic hydrocarbon, which has risen through said thioetherification catalyst and, (d) removing said net bottoms stream and said net overhead stream, comprising paraffinic hydrocarbons, from the column.

2. The process of claim 1 wherein the feed stream also comprises a second paraffinic hydrocarbon, having a different number of carbon atoms per molecule than the first paraffinic hydrocarbon and at least 60 mole percent of the second paraffinic hydrocarbon is concentrated into said net bottoms stream.

3. The process of claim 1 wherein the thioetherification catalyst has a different composition than the oligomerization catalyst.

4. The process of claim 1 wherein the second elevation is located above the first elevation.

5. The process of claim 1 wherein the first feed olefinic hydrocarbon and the first feed paraffinic hydrocarbon have four carbon atoms per molecule.

6. A process for the removal of mercaptans and $C_4$ olefins from a $C_4$ paraffin-rich feed stream which comprises the steps:

(a) passing the feed stream, comprising $C_4$ feed paraffinic hydrocarbons, $C_4$ feed olefinic hydrocarbons and at least one coboiling mercaptan, with the mercaptan and the olefinic hydrocarbons being present in the feed stream at a concentration of less than 10 volume % each, into a catalytic distillation column operated at conditions effective to separate the compounds present in the column into a net overhead stream, which comprises substantially all of the lightest feed paraffinic hydrocarbon which enters the column in the feed stream, and a net bottoms stream which comprises sulfur compounds and dimers of the $C_4$ olefinic hydrocarbons present in the feed stream;

(b) contacting the $C_4$ olefinic hydrocarbons and mercaptan, in the substantial absence of hydrogen, with a bed of thioetherification catalyst located at a first level in the catalytic distillation column and maintained at conditions which effect the production of thioethers by the reaction of mercaptans present in the feed stream with olefinic hydrocarbons present in the feed stream;

(c) contacting the $C_4$ remaining olefinic hydrocarbons, in the substantial absence of hydrogen and thioethers, with a bed of oligomerization catalyst located at a second, higher level in the catalytic distillation column and maintained at conditions which effect the production of oligomers my the dimerization of olefinic hydrocarbons which have risen through said first catalyst bed and, (d) removing said net bottoms stream and the net overhead stream, comprising $C_4$ paraffinic hydrocarbons, from the column.

7. The process of claim 6 wherein the feed stream comprises isobutylene.

8. The process of claim 6 wherein the thioetherification catalyst comprises a sulfonated acid resin.

9. The process of claim 6 wherein the same catalyst is employed as both the thioetherification catalyst and the oligomerization catalyst, with the average residence time of hydrocarbons in the bed of oligomerization catalyst being longer than the average residence time of hydrocarbons in the thioetherification zone.

10. The process of claim 6 wherein the thioetherification catalyst comprises MCM-41 or a Saponite clay.

11. The process of claim 6 wherein the feed comprises two paraffinic hydrocarbons having different number of carbon atoms per molecule and one of the paraffinic hydrocarbons is concentrated into the net bottoms stream.

12. A process for decreasing the concentration of mercaptans and $C_4$ olefins in a $C_4$ paraffin-rich process unit feed stream which comprises the steps of:

(a) passing the feed stream, which comprises at least 50 percent $C_4$ feed paraffinic hydrocarbons, about 0.01 to 5.0 percent $C_4$ feed olefinic hydrocarbons and at least one coboiling mercaptan, with the mole ratio of tertiary olefins to mercaptans in the feed stream being greater than about 1:1, into a catalytic distillation column operated at conditions which effect the separation of the compounds present in the column into a net overhead stream, which comprises substantially all of the paraffinic hydrocarbons which enter the column in the feed stream, and a net bottoms stream which comprises sulfur compounds and dimers formed from compounds present in the feed stream;

(b) contacting the $C_4$ olefinic hydrocarbons and mercaptan, in the substantial absence of hydrogen, with a bed of acidic thioetherification catalyst located at a first level in the catalytic distillation column, which is located above the point at which the feed stream enters the column and maintained at conditions which effect the production of thioethers by the reaction of mercaptans present in the feed stream with tertiary olefinic hydrocarbons present in the feed stream;

(c) passing the remaining $C_4$ olefinic hydrocarbons upward in the catalytic distillation column and contacting the remaining $C_4$ olefinic hydrocarbons, in the substantial absence of thioethers or hydrogen, with a bed of oligomerization catalyst located at a second, higher level in the catalytic distillation column and maintained at conditions which effect the production of oligomers by the reaction of olefinic hydrocarbons which have risen through said first catalyst bed; and, (d) removing said net bottoms stream and the net overhead stream, which is substantially free of mercaptans and olefinic hydrocarbons from the column.

13. The process of claim 12 wherein the feed stream also comprises an isobutylene.

14. The process of claim 12 wherein the thioetherification catalyst comprises an acidic material chosen from the group consisting of MCM-41, Saponite clay, and a sulfonated acid resin.

15. The process of claim 12 wherein the oligomerization catalyst comprises a material chosen from the group consisting of dealuminated Y zeolite, synthetic mica-montmorillonite, MCM-41 and supported nickel oxide.

16. The process of claim 12 wherein the thioetherification catalyst has a different composition than the oligomerization catalyst.

17. The process of claim 12 wherein the mercaptan is ethyl or methyl mercaptan.

18. The process of claim 12 wherein the feed stream also comprises a heavy paraffinic hydrocarbon having more than four carbon atoms per molecule and the heavy paraffinic hydrocarbon is concentrated into the net bottoms stream.

* * * * *